US009959989B2

(12) United States Patent
Huang

(10) Patent No.: US 9,959,989 B2
(45) Date of Patent: May 1, 2018

(54) KEY STRUCTURE

(71) Applicant: PRIMAX ELECTRONICS LTD., Taipei (TW)

(72) Inventor: Wei-Yung Huang, Taipei (TW)

( * ) Notice: Subject to any disclaimer, the term of this patent is extended or adjusted under 35 U.S.C. 154(b) by 0 days. days.

(21) Appl. No.: 15/359,940

(22) Filed: Nov. 23, 2016

(65) Prior Publication Data

US 2018/0075985 A1 Mar. 15, 2018

(30) Foreign Application Priority Data

Sep. 9, 2016 (TW) ..... 105129344 A

(51) Int. Cl.
*H01H 13/70* (2006.01)
*H01H 13/14* (2006.01)
*H01H 13/50* (2006.01)

(52) U.S. Cl.
CPC ..... *H01H 13/14* (2013.01); *H01H 13/50* (2013.01)

(58) Field of Classification Search
CPC .... H01H 13/7065; H01H 3/125; H01H 13/14; H01H 13/50
USPC ..... 200/344
See application file for complete search history.

(56) References Cited

U.S. PATENT DOCUMENTS

2014/0318942 A1* 10/2014 Takemae ..... H01H 3/125 200/5 A
2016/0148763 A1* 5/2016 Chen ..... H01H 13/704 200/341

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

A key structure includes a base plate, a position-limiting structure, a stabilizer bar and a keycap. The position-limiting structure is connected with and fixed on the base plate. A slot is defined by the position-limiting structure and the base plate. The stabilizer bar is connected with the keycap and pivotally coupled to the slot. The position-limiting structure includes a top stopper. The top stopper is made of soft material. As the stabilizer bar is rotated and the stabilizer bar is contacted with the top stopper, the efficacy of reducing noise is enhanced.

9 Claims, 4 Drawing Sheets

KEY STRUCTURE

FIELD OF THE INVENTION

The present invention relates to a key structure, and more particularly to a key structure with a position-limiting structure that is made of two different materials.

BACKGROUND OF THE INVENTION

As known, keyboards are indispensable input devices for people in the modern societies. Generally, plural keys are installed on a top surface of the keyboard. Via the keyboard, the user can press one or more keys to input a command. According to the functions, the keycaps of the keys of the keyboard have different lengths. Consequently, the keys are classified into longer keys and shorter keys.

However, the operation of the longer key has a problem. For example, if the pressing force of the user is applied to a specified end of the two ends of the longer key in the longitudinal direction, the specified end is moved downwardly but the other end is not moved downwardly. For solving this problem, a stabilizer bar is located under the longer key. Due to the stabilizer bar, the longer key can be uniformly descended in response to the pressing force.

The use of the stabilizer bar results in another problem. For example, noise is possibly generated at the coupling regions of the stabilizer bar. That is, while the keycap is pressed down, the ends of the stabilizer bar are moved downwardly to collide with the coupling regions of the stabilizer bar. Consequently, the unpleasant noise is generated.

In other words, the conventional key structure needs to be further improved.

SUMMARY OF THE INVENTION

The present invention provides a key structure with a position-limiting structure that is made of two different materials. As a stabilizer bar is rotated, the stabilizer bar is contacted with a softer portion of the position-limiting structure. Consequently, the generated noise is reduced, and the performance of reducing the noise is enhanced.

In accordance with an aspect of the present invention, there is provided a key structure. The key structure includes a base plate, a membrane circuit board, at least one position-limiting structure, at least one stabilizer bar and a keycap. The membrane circuit board is located over the base plate. The position-limiting structure includes a top stopper and a sidewall. The top stopper and the sidewall are connected with each other. The sidewall is penetrated through the membrane circuit board and connected with and fixed on the base plate. A slot is defined by the top stopper, the sidewall and the base plate collaboratively. Moreover, a material hardness of the top stopper is lower than a material hardness of the sidewall. The stabilizer bar includes a main bar part and at least one lateral bar part. The main bar part and the at least one lateral bar part are connected with each other. A distal end of the lateral bar part is pivotally coupled to the slot. The top stopper is contacted with the distal end of the lateral bar part in response to rotation of the stabilizer bar. The main bar part is pivotally coupled to a bottom surface of the keycap.

In an embodiment, the key structure further includes an elastic supporting element. The elastic supporting element is arranged between the keycap and the membrane circuit board. Moreover, two ends of the elastic supporting element are contacted with the keycap and the membrane circuit board, respectively.

In an embodiment, the key structure further includes a movable supporting element. The movable supporting element is arranged between the keycap and the base plate. The movable supporting element includes a first coupling end and a second coupling end. The first coupling end is connected with the bottom surface of the keycap. The second coupling end is penetrated through the membrane circuit board and connected with the base plate.

In an embodiment, the movable supporting element is a scissors-type supporting element.

In an embodiment, the at least one position-limiting structure includes two position-limiting structures, and the at least one lateral bar part includes two lateral bar parts. The two lateral bar parts are respectively extended from two ends of the main bar part. The distal end of each lateral bar part is bent toward the corresponding slot and hooking the corresponding slot.

In an embodiment, the keycap has two long edges and two short edges. The at least one stabilizer bar includes two stabilizer bars. Moreover, two slots are defined by each position-limiting structure and the base plate. The two main bar parts of the two stabilizer bars are respectively located near and under the two long edges of the keycap. The two position-limiting structures are respectively located near and under the two short edges of the keycap.

In an embodiment, the sidewall includes at least one hot melt post, and the base plate includes at least one hot melt hole. The at least one hot melt post is inserted into the at least one hot melt hole. Moreover, the at least one hot melt post and the at least one hot melt hole are combined together by a thermal melting process.

In an embodiment, the top stopper is made of rubbery material, and the sidewall is made of plastic material.

In an embodiment, the top stopper and the sidewall are formed by a co-injection molding process.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
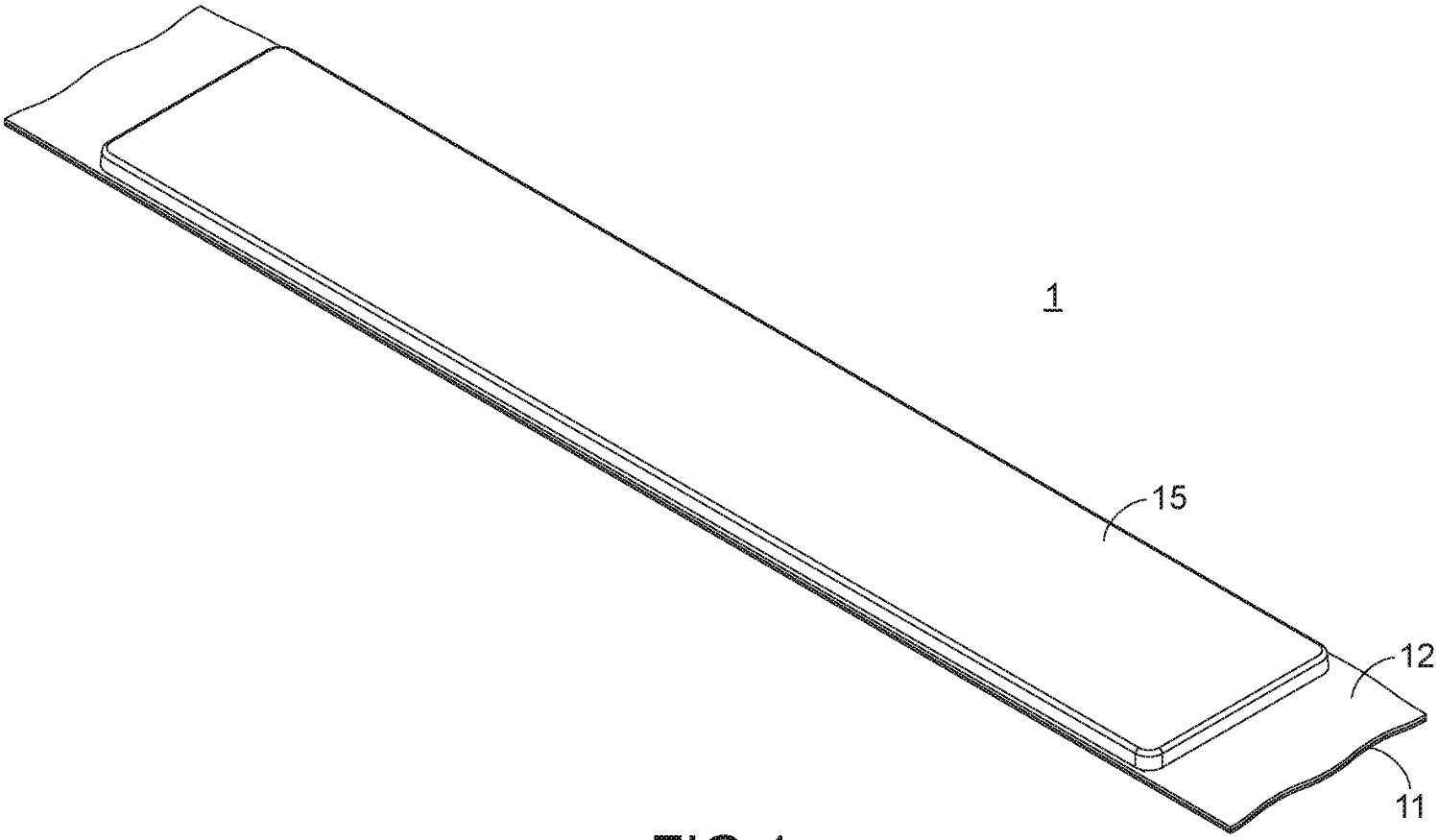
FIG. 1 is a schematic perspective view illustrating a key structure according to an embodiment of the present invention.

FIG. 1 is a schematic perspective view illustrating a key structure according to an embodiment of the present invention. The key structure 1 as shown in FIG. 1 is a longer key of a keyboard. The key structure 1 comprises a keycap 15. The keycap 15 has two long edges and two short edges. A membrane circuit board 12 is located under the keycap 15.

When the keycap 15 is pressed down by a user, the membrane circuit board 12 generates an input signal. The membrane circuit board 12 is usually a film layer. Consequently, a base plate 11 is located under the membrane circuit board 12 to support the membrane circuit board 12.

Figure 2:
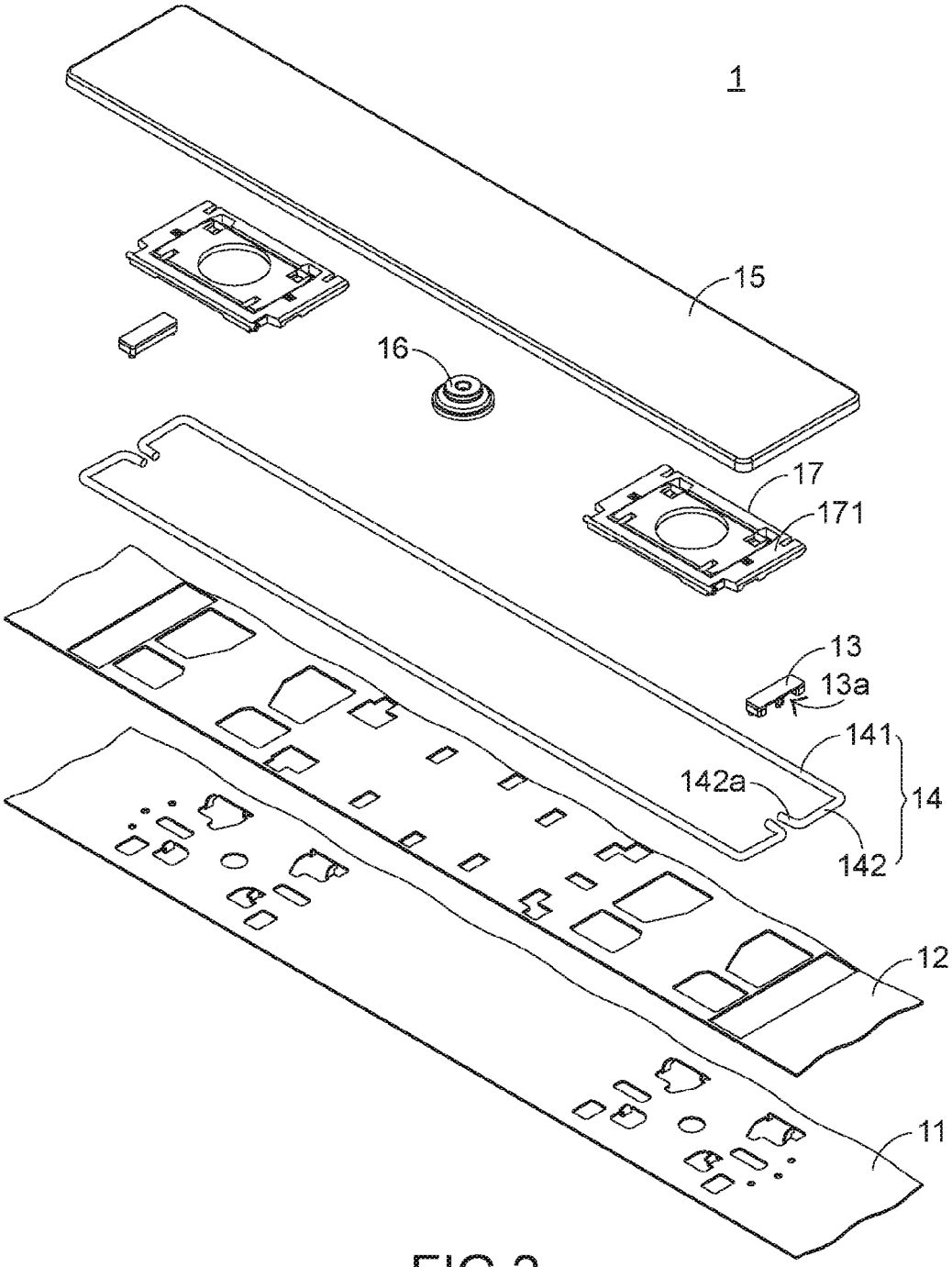
FIG. 2 is a schematic exploded view illustrating the key structure according to the embodiment of the present invention and taken along a viewpoint.
Figure 3:
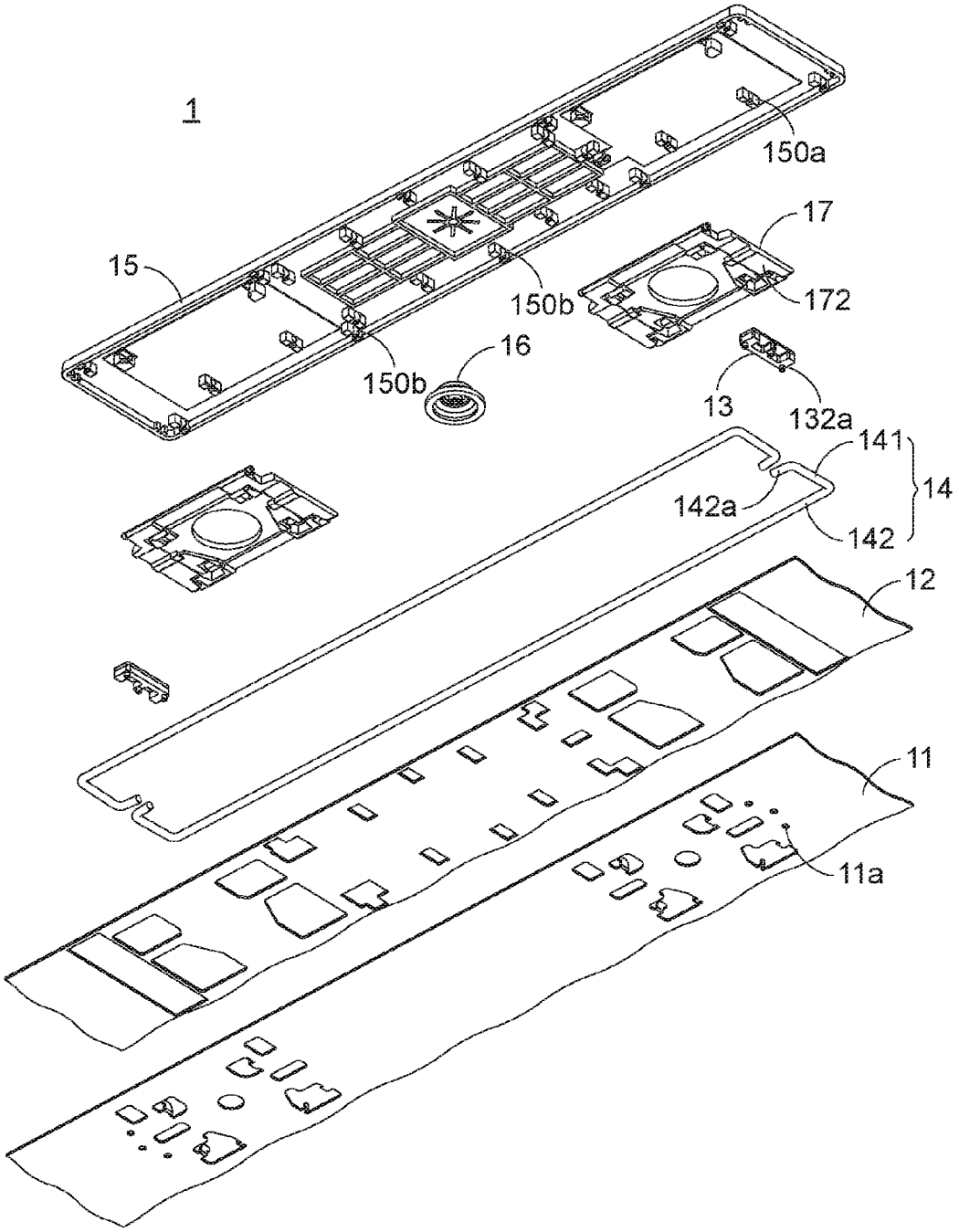
FIG. 3 is a schematic exploded view illustrating the key structure according to the embodiment of the present invention and taken along another viewpoint.

FIG. 2 is a schematic exploded view illustrating the key structure according to the embodiment of the present invention and taken along a viewpoint. FIG. 3 is a schematic exploded view illustrating the key structure according to the embodiment of the present invention and taken along another viewpoint. As shown in FIGS. 2 and 3, the key structure 1 comprises the base plate 11, the membrane circuit board 12, at least one position-limiting structure 13, at least one stabilizer bar 14 and the keycap 15. The relationship between the base plate 11, the membrane circuit board 12 and the keycap 15 has been mentioned as above. The stabilizer bar 14 is connected with the keycap 15 and the base plate 11. Moreover, the stabilizer bar 14 is arranged between the keycap 15 and the base plate 11. Due to the stabilizer bar 14, the keycap 15 can be uniformly descended in response to a pressing force.

The stabilizer bar 14 comprises a main bar part 141 and at least one lateral bar part 142. The main bar part 141 and the at least one lateral bar part 142 are connected with each other. Preferably, in this embodiment, the stabilizer bar 14 comprises two lateral bar parts 142. The two lateral bar parts 142 are extended from two ends of the main bar part 141, respectively. The main bar part 141 is pivotally to a bottom surface 150 of the keycap 15 (see FIG. 3). Moreover, plural hooks 150*b* are arranged in a line and protruded from the bottom surface 150 of the keycap 15. The main bar part 141 is a straight lever that is locked into the corresponding hooks 150*b*. According to this design, the main bar part 141 is pivotally coupled to the keycap 15.

Figure 4:
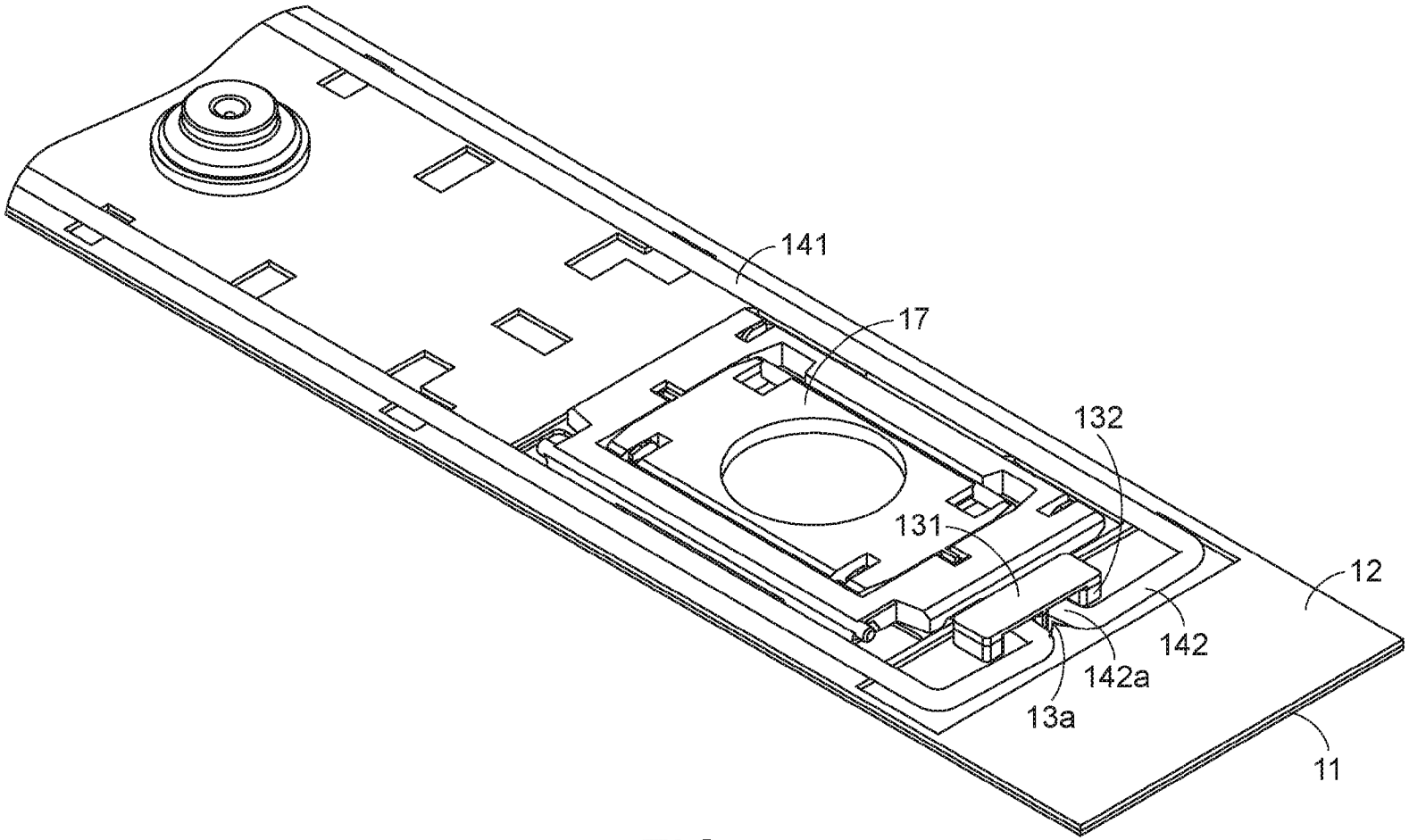
FIG. 4 is a schematic assembled view of the key structure according to the embodiment of the present invention, in which the keycap of the key structure is not shown.

FIG. 4 is a schematic assembled view of the key structure according to the embodiment of the present invention, in which the keycap of the key structure is not shown. Please refer to FIGS. 2, 3 and 4. In this embodiment, the at least one position-limiting structure 13 comprises two position-limiting structures 13. The two position-limiting structures 13 are located under the two short edges of the keycap 15, respectively. Each position-limiting structure 13 comprises a top stopper 131 and a sidewall 132. The sidewall 132 is penetrated through the membrane circuit board 12, and connected with and fixed on the base plate 11. The top stopper 131 is located at a top side of the sidewall 132. The base plate 11 is located at a top side of the sidewall 132. Moreover, a slot 13*a* is defined by the top stopper 131, the sidewall 132 and the base plate 11 collaboratively. The distal end 142*a* of the lateral bar part 142 is pivotally coupled to the slot 13*a*. Preferably, the distal end 142*a* of the lateral bar part 142 is bent toward the slot 13*a*. Moreover, the distal end 142*a* of the lateral bar part 142 is hooked and pivotally coupled to the slot 13*a*.

As shown in FIG. 3, the sidewall 132 comprises at least one hot melt post 132*a*, and the base plate 11 comprises at least one hot melt hole 11*a*. After the at least one hot melt post 132*a* is inserted into the at least one hot melt hole 11*a*, the at least one hot melt post 132*a* and the at least one hot melt hole 11*a* are treated by a thermal melting process. Consequently, the position-limiting structure 13 is securely fixed on the base plate 11.

In accordance with a feature of the present invention, the position-limiting structure 13 is used for limiting the position of the distal end 142*a* of the lateral bar part 142. As the keycap 15 is pressed down and the stabilizer bar 14 is rotated, the distal end 142*a* of the lateral bar part 142 is slightly moved and contacted with the position-limiting structure 13. Consequently, a sound is generated. Generally, in response to the rotation of the stabilizer bar 14, the distal end 142*a* of the lateral bar part 142 is upturned to collide with the position-limiting structure 13. At the same time, the top stopper 131 is contacted with the distal end 142*a* of the lateral bar part 142. The top stopper 131 is located at a top end of the sidewall 132. The material hardness of the top stopper 131 is lower than the material hardness of the sidewall 132. Preferably, the top stopper 131 is made of rubbery material, and the sidewall 132 is made of plastic material. Moreover, the top stopper 131 and the sidewall 132 are formed by a co-injection molding process. According to this design, the generated noise is reduced when the distal end 142*a* of the lateral bar part 142 contacts or collides with the top stopper 131.

The key structure 1 further comprises an elastic supporting element 16. In an embodiment, the elastic supporting element 16 is rubbery dome. The elastic supporting element 16 is arranged between the keycap 15 and the membrane circuit board 12. Moreover, the two ends of the elastic supporting element 16 are contacted with the keycap 15 and the membrane circuit board 12, respectively. As the keycap 15 is pressed down, the elastic supporting element 16 is pressed and subjected to deformation. Consequently, the elastic supporting element 16 stores elastic potential energy. When the elastic supporting element 16 is no longer pressed, the elastic supporting element 16 releases the elastic potential energy. Consequently, the keycap 15 is returned to its original position.

The key structure 1 further comprises a movable supporting element 17. In an embodiment, the movable supporting element 17 is a scissors-type supporting element. The movable supporting element 17 is arranged between the keycap 15 and the base plate 11. The movable supporting element 17 comprises a first coupling end 171 and a second coupling end 172. The first coupling end 171 is connected with the corresponding hooks 150*b* of the bottom surface 150 of the keycap 15. The second coupling end 172 is penetrated through the membrane circuit board 12 and connected with the base plate 11.

In an embodiment, the key structure 1 comprises two stabilizer bars 14. The two stabilizer bars 14 are located under the two long edges of the keycap 15, respectively. Moreover, two slots 13*a* are defined by each position-limiting structure 13 and the base plate 11. Consequently, the two stabilizer bars 14 are pivotally coupled to the slots 13*a*. According to this design, the keycap 15 can be stably and uniformly descended in response to the pressing force. It is noted that the number of the stabilizer bars 14 is not restricted.

From the above descriptions, the present invention provides the key structure. The position-limiting structure of the key structure is made of two different materials. As the stabilizer bar is rotated, the noise is reduced or eliminated in response to the contact or collision between the stabilizer bar and the softer top stopper.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

a membrane circuit board located over the base plate;

at least one position-limiting structure comprising a top stopper and a sidewall, wherein the top stopper and the sidewall are connected with each other, the sidewall is penetrated through the membrane circuit board and connected with and fixed on the base plate, a slot is defined by the top stopper, the sidewall and the base plate collaboratively, and a material hardness of the top stopper is lower than a material hardness of the sidewall;

at least one stabilizer bar comprising a main bar part and at least one lateral bar part, wherein the main bar part and the at least one lateral bar part are connected with each other, and a distal end of the lateral bar part is pivotally coupled to the slot, wherein the top stopper is contacted with the distal end of the lateral bar part in response to rotation of the stabilizer bar; and a keycap, wherein the main bar part is pivotally coupled to a bottom surface of the keycap.

2. The key structure according to claim 1, further comprising an elastic supporting element, wherein the elastic supporting element is arranged between the keycap and the membrane circuit board, and two ends of the elastic supporting element are contacted with the keycap and the membrane circuit board, respectively.

3. The key structure according to claim 1, further comprising a movable supporting element, wherein the movable supporting element is arranged between the keycap and the base plate, and the movable supporting element comprises a first coupling end and a second coupling end, wherein the first coupling end is connected with the bottom surface of the keycap, and the second coupling end is penetrated through the membrane circuit board and connected with the base plate.

4. The key structure according to claim 3, wherein the movable supporting element is a scissors-type supporting element.

5. The key structure according to claim 1, wherein the at least one position-limiting structure comprises two position-limiting structures and two lateral bar parts, wherein the two lateral bar parts are respectively extended from two ends of the main bar part, and the distal end of each lateral bar part is bent toward a corresponding slot and hooking the corresponding slot.

6. The key structure according to claim 5, wherein the keycap has two long edges and two short edges, the at least one stabilizer bar comprises two stabilizer bars each comprising a respective main bar part, and two slots are defined by each position-limiting structure and the base plate, wherein the two main bar parts of the two stabilizer bars are respectively located near and under the two long edges of the keycap, and the two position-limiting structures are respectively located near and under the two short edges of the keycap.

7. The key structure according to claim 1, wherein the sidewall comprises at least one hot melt post, and the base plate comprises at least one hot melt hole, wherein the at least one hot melt post is inserted into the at least one hot melt hole, and the at least one hot melt post and the at least one hot melt hole are combined together by a thermal melting process.

8. The key structure according to claim 1, wherein the top stopper is made of rubbery material, and the sidewall is made of plastic material.

9. The key structure according to claim 1, wherein the top stopper and the sidewall are formed by a co-injection molding process.

* * * * *